US011685970B2

(12) United States Patent
Hara et al.

(10) Patent No.: US 11,685,970 B2
(45) Date of Patent: Jun. 27, 2023

(54) IRIDIUM ALLOY

(71) Applicants: DENSO CORPORATION, Kariya (JP); ISHIFUKU METAL INDUSTRY CO., LTD., Tokyo (JP)

(72) Inventors: Satoshi Hara, Kariya (JP); Nobuo Abe, Kariya (JP); Kenta Terai, Soka (JP); Shunsuke Takeya, Soka (JP); Hayato Yasuhara, Soka (JP)

(73) Assignees: DENSO CORPORATION, Kariya (JP); ISHIFUKU METAL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/890,405

(22) Filed: Aug. 18, 2022

(65) Prior Publication Data

US 2023/0072558 A1 Mar. 9, 2023

(30) Foreign Application Priority Data

Aug. 20, 2021 (JP) ..... 2021-134663

(51) Int. Cl.
*C22C 5/04* (2006.01)

(52) U.S. Cl.
CPC ..... *C22C 5/04* (2013.01)

(58) Field of Classification Search
CPC ..... C22C 5/04; C22F 1/14
See application file for complete search history.

(56) References Cited

U.S. PATENT DOCUMENTS

2008/0206090 A1* 8/2008 Ishida ..... C22C 5/04 420/461
2019/0338395 A1 11/2019 Yokota et al.

FOREIGN PATENT DOCUMENTS

JP 2010-138418 6/2010

* cited by examiner

*Primary Examiner* — Jessee R Roe
(74) *Attorney, Agent, or Firm* — Nixon & Vanderhye P.C.

(57) ABSTRACT

An iridium alloy includes iridium, platinum, and tantalum. A content of the platinum in the iridium alloy falls within a range from 5 wt % to 30 wt %, and a content of the tantalum in the iridium alloy falls within a range from 0.3 wt % to 5 wt %.

3 Claims, No Drawings

IRIDIUM ALLOY

CROSS REFERENCE TO RELATED APPLICATION

This application is based on Japanese Patent Application No. 2021-134663 filed on Aug. 20, 2021, the disclosure of which is incorporated herein by reference in its entirety.

TECHNICAL FIELD

The present disclosure relates to an iridium alloy.

BACKGROUND

An iridium alloy containing platinum or the like in iridium is known as a material having excellent heat resistance and corrosion resistance, and is used in various fields.

SUMMARY

An iridium alloy according to the present disclosure includes iridium, platinum and tantalum. The content of the platinum falls within a range from 5 wt % to 30 wt % and the content of the tantalum falls within a range from 0.3 wt % to 5 wt %.

DESCRIPTION OF EMBODIMENTS

To begin with, examples of relevant techniques will be described.

An iridium alloy containing platinum or the like in iridium is known as a material having excellent heat resistance and corrosion resistance, and is used in various fields. For example, a predetermined amount of platinum and a predetermined amount of an alkaline earth metal element are added to an iridium alloy, thereby making it possible to use so the iridium alloy stably for a long period of time under a high temperature environment.

In recent years, requirements for durability of iridium alloys has become even higher. For example, in the field of spark plugs, the current and voltage of spark plugs are increasing to increase output of an internal combustion engine and improve fuel efficiency. Thus, the iridium alloy, which is a material for a discharge unit of a spark plug, requires higher level of durability than before, and the iridium alloy described in the above patent literature will be unable to meet the requirements in future. Also in fields other than spark plugs, the level of durability required for iridium alloys is expected to further increase in the future.

It is objective of the present disclosure to provide an iridium alloy having a high durability.

An iridium alloy according to the present disclosure includes iridium, platinum and tantalum. The content of the platinum falls within a range from 5 wt % to 30 wt % and the content of the tantalum falls within a range from 0.3 wt % to 5 wt %.

The iridium alloy having the iridium content and the tantalum content within the range described above can improve durability when exposed to a high-temperature oxidizing atmosphere (for example, the air atmosphere).

According to the present disclosure, an iridium alloy having high durability is provided.

Hereinafter, present embodiment will be described.

An iridium alloy according to the first embodiment contains a predetermined amount of platinum (Pt) and a predetermined amount of tantalum (Ta) in iridium (Ir). The platinum content in the iridium alloy preferably falls within the range from 5 wt % to 30 wt %. The tantalum content in the iridium alloy preferably falls within the range from 0.3 wt % and 5 wt %.

When the iridium alloy contains platinum, oxidative volatilization of the iridium from grain boundaries can be reduced when the iridium alloy is exposed to the high-temperature oxidizing atmosphere (e.g., the air atmosphere). As a result, resistance of the iridium alloy against oxidative consumption can be significantly improved. The present inventors have confirmed that the above effect is not sufficiently exhibited when the platinum content in the iridium alloy is less than 5 wt %.

On the other hand, when the platinum content in the iridium alloy is greater than 30 wt %, the resistance of the iridium alloy against oxidative consumption is further increased. However, in this case, both the melting point and the recrystallization temperature of the iridium alloy are lowered, so that the upper limit of the temperature range in which the iridium alloy can be stably used is lowered.

As described above, in the iridium alloy according to the present embodiment, the platinum content is set within the range between 5 wt % and 30 wt %.

When tantalum is contained in the iridium alloy, the strength of the iridium alloy is improved by solid solution hardening and the recrystallization temperature also rises. Since the recrystallization temperature of the iridium alloy rises, the fine structure of the iridium alloy is maintained even at a high temperature, and the crystal grains of the iridium alloy are less likely to fall off. Further, as the recrystallization temperature rises, the softening of the iridium alloy at high temperatures is suppressed. As a result, the durability of the iridium alloy is improved. The present inventors have confirmed that the above effects are not sufficiently exhibited when the tantalum content in the iridium alloy is less than 0.3 wt %.

On the other hand, when the tantalum content in the iridium alloy is greater than 5 wt %, the density of the iridium alloy decreases. Thus, the present inventors have confirmed that, when the discharge portion of the spark plug is formed of the iridium alloy having tantalum content of 5 wt % or more, the resistance against wear caused by the spark discharge is lowered. Further, when the tantalum content in the iridium alloy is greater than 5 wt %, the solid solution hardening of the iridium alloy excessively occurs, and as a result, the plastic deformability of the iridium alloy is lowered and the processing of the iridium alloy becomes difficult. Further, oxidation of other elements contained in the iridium alloy (for example, cobalt and nickel described later) is likely to occur, which may lower the oxidative consumption resistance.

As described above, in the iridium alloy according to the present embodiment, as described above, the tantalum content is set to be within the range between 0.3 wt % and 5 wt %. The present inventors have confirmed that the tantalum content in the iridium alloy is more preferably 0.5 wt % or more, and further preferably 0.7 wt % or more.

In the second embodiment, an additive made of cobalt, nickel, or both of cobalt and nickel is added to the iridium alloy of the first embodiment in place of a part of the iridium. The additive may be a material containing only cobalt element, a material containing only nickel element or a material formed by mixing both of cobalt element and nickel element at an arbitrary ratio. In any case, the content of the additive in the iridium alloy is preferably in the range up to 1.5 wt %.

When the iridium alloy including iridium, platinum and tantalum contains the above additive within the range up to 1.5 wt %, the above-mentioned solid solution hardening is promoted, and the strength of the iridium alloy can be further improved. Further, when the iridium alloy is exposed to the high-temperature oxidizing atmosphere (for example, an air atmosphere of 1200° C. or higher), an oxide of the additive is generated and distributed at the grain boundaries of the iridium alloy. This oxide functions as a protective material for the iridium alloy and suppresses the outward diffusion of iridium and the subsequent oxidative volatilization of iridium, so that the oxidative consumption resistance of the iridium alloy is further increased.

On the other hand, the present inventors have confirmed that, when the content of the additive in the iridium alloy is greater than 1.5 wt %, the oxide of the additive is excessively generated and the oxidation consumption resistance of the iridium alloy is actually lowered. In addition, the melting point of the iridium alloy is lowered in this case. Thus, the upper limit of the temperature range in which the iridium alloy can be stably used is lowered.

and the additive exceeds 5 wt %, the processability of the iridium alloy is lowered. It is considered that this is because the work hardening associated with the addition of tantalum is excessively promoted by the above-mentioned additive. Thus, the total content of tantalum and the additive in the iridium alloy preferably falls within the range up to 5 wt %.

In any of the above embodiments, the iridium alloy is a single-phase solid solution without second phase. Therefore, the ductility of the iridium alloy is good, and the iridium alloy can be plastically processed using known methods such as warm working and hot working. In addition, machining and welding can be easily performed.

<First Example>

The present inventors prepared a plurality of iridium alloy test pieces that are included in the above embodiments as "examples", and a plurality of iridium alloy test pieces that are not included in the above embodiments as "comparative examples", and evaluated these test pieces. Table 1 shows parameters such as density and evaluation results such as processability for each test piece.

TABLE 1

| | | | Content | | | | | | Solid phase | Oxidative consumption resistance | | Recrystallization | | High temp. | | Total |
|---|---|---|---|---|---|---|---|---|---|---|---|---|---|---|---|---|
| | No. | density | Ir | Pt | Ta | Ni | Co | Prosessability | point | 1000° C. | 1200° C. | temp. (° C.) | | strength | | evaluation |
| Examples | 1 | 22.35 | R | 5 | 0.3 | — | — | B | B | A | A | 1100 | B | 255 | B | B |
| | 2 | 21.99 | R | 5 | 5 | — | — | B | B | A | A | 1250 | A | 552 | A | A |
| | 3 | 22.10 | R | 7 | 3 | — | — | B | B | A | A | 1250 | A | 407 | B | A |
| | 4 | 22.30 | R | 10 | 0.3 | — | — | B | B | A | A | 1100 | B | 303 | B | B |
| | 5 | 22.70 | R | 10 | 0.5 | — | — | B | B | A | A | 1100 | B | 324 | B | B |
| | 6 | 22.20 | R | 10 | 1.5 | — | — | B | B | A | A | 1150 | B | 418 | B | B |
| | 7 | 22.09 | R | 10 | 3 | — | — | B | B | A | A | 1250 | A | 526 | B | B |
| | 8 | 22.05 | R | 10 | 3.5 | — | — | B | B | A | B | 1250 | A | 553 | A | B |
| | 9 | 22.02 | R | 10 | 4 | — | — | B | B | A | B | 1250 | A | 577 | A | B |
| | 10 | 21.94 | R | 10 | 5 | — | — | B | B | A | B | 1250 | A | 610 | A | B |
| | 11 | 22.04 | R | 10 | 1.5 | 0.5 | — | B | B | B | A | 1100 | B | 517 | B | B |
| | 12 | 21.88 | R | 10 | 1.5 | 1 | — | B | B | B | A | 1100 | B | 597 | A | B |
| | 13 | 21.62 | R | 10 | 1.5 | 1.5 | — | B | B | B | A | 1100 | B | 623 | A | B |
| | 14 | 21.89 | R | 10 | 3.5 | 0.5 | — | B | B | B | A | 1200 | A | 593 | A | B |
| | 15 | 21.85 | R | 10 | 4 | 0.5 | — | B | B | B | A | 1200 | A | 597 | A | B |
| | 16 | 21.69 | R | 10 | 4 | 1 | — | B | B | B | A | 1200 | A | 618 | A | B |
| | 17 | 21.76 | R | 10 | 3 | — | 1 | B | B | B | A | 1150 | A | 618 | A | B |
| | 18 | 21.66 | R | 10 | 3 | — | 1.5 | B | B | B | A | 1150 | A | 639 | A | B |
| | 19 | 21.98 | R | 20 | 3 | — | — | B | B | A | A | 1250 | A | 542 | B | B |
| | 20 | 21.95 | R | 25 | 3 | — | — | B | B | A | A | 1250 | A | 584 | A | A |
| | 21 | 22.11 | R | 27 | 0.5 | — | — | B | B | A | A | 1100 | B | 562 | A | B |
| | 22 | 22.04 | R | 27 | 1.5 | — | — | B | B | A | A | 1150 | B | 575 | A | B |
| | 23 | 21.92 | R | 27 | 3 | — | — | B | B | A | A | 1250 | A | 595 | A | A |
| | 24 | 21.85 | R | 27 | 4 | — | — | B | B | A | A | 1250 | A | 599 | A | A |
| | 25 | 21.87 | R | 27 | 1.5 | 0.5 | — | B | B | B | A | 1150 | B | 629 | A | B |
| | 26 | 21.80 | R | 27 | 0.3 | 1 | — | B | B | B | A | 1100 | B | 602 | A | B |
| | 27 | 21.69 | R | 27 | 4 | 0.5 | — | B | B | B | A | 1200 | A | 657 | A | B |
| | 28 | 21.60 | R | 27 | 3 | 1 | — | B | B | B | A | 1200 | A | 627 | A | B |
| | 29 | 22.10 | R | 30 | 0.3 | — | — | B | B | A | A | 1100 | B | 575 | A | B |
| | 30 | 21.75 | R | 30 | 5 | — | — | B | B | A | B | 1250 | A | 610 | A | B |
| | 31 | 21.56 | R | 10 | 3.5 | 0.5 | 1 | B | B | B | A | 1200 | A | 695 | A | B |
| | 32 | 21.56 | R | 10 | 3.5 | 1 | 0.5 | B | B | B | A | 1200 | A | 683 | A | B |
| Comparative example | 1 | 22.32 | R | 10 | — | — | — | B | B | B | A | 1050 | C | 224 | C | C |
| | 2 | 21.87 | R | 10 | 6 | — | — | D | — | — | — | — | — | — | — | D |
| | 3 | 22.30 | R | 10 | 0.1 | — | — | B | B | B | A | 1050 | C | 241 | C | C |
| | 4 | 21.30 | R | 10 | 3.5 | 2 | — | D | — | — | — | — | — | — | — | D |
| | 5 | 21.41 | R | 10 | 3.5 | — | 2 | D | — | — | — | — | — | — | — | D |
| | 6 | 21.35 | R | 10 | 3.5 | 1 | 1 | D | — | — | — | — | — | — | — | D |

As described above, in the iridium alloy according to the present embodiment, the content of the additive is set to a value within the range up to 1.5 wt %.

The present inventors have confirmed that, even when the content of the additive in the iridium alloy falls within the range up to 1.5 wt %, when the total content of the tantalum In the column of "No." in Table 1, a unique number corresponding to each test piece is shown. Examples are numbered from 1 to 32, and comparative examples are numbered from 1 to 6. In the column of "density" in Table 1, the density of each test piece is shown in the unit of "g/cm$^3$". In the column of "content" in Table 1, the contents of iridium (Ir), platinum (Pt), tantalum (Ta), nickel (Ni), and cobalt (Co) in each test piece is shown in the unit of "wt %" and "R" means the remainder. The entirety of nickel and cobalt corresponds to the above-mentioned "additive".

<Method for Preparing Test Pieces>

In preparing the test pieces shown in Table 1, iridium powder, platinum powder, tantalum powder, nickel powder, and cobalt powder were prepared. Next, these material powders were mixed at a ratio corresponding to each test piece to prepare a mixed powder.

After that, each mixed powder was molded into a green compact using a uniaxial pressure molding machine, and the obtained green compact was melted through an arc melting method to prepare an ingot to be each test piece. Next, each ingot was hot forged at a high temperature of 1500° C. or higher to form a square bar having a width of 15 mm, and each square bar was processed into a wire rod having a diameter of 0.5 mm, which was used as a test piece. The processing from the square bar to the wire rod was performed by groove rolling the square bar at a temperature within a range from 1000° C. to 1400° C. and then performing dies wire drawing.

After preparing the plurality of test pieces through the above method, the present inventors evaluated each test piece in various items. The results of each test piece are shown in the columns of "processability", "solid phase point", "oxidative consumption resistance", "recrystallization temperature", "high temperature strength", and "total evaluation" in Table 1. Details such as the evaluation method for each item are as follows.

<Evaluation Method of Processability>

The processability was evaluated based on whether or not the above-mentioned square bar could be processed into a wire rod. The processability is evaluated as "D" for those in which cracks occurred during processing and wire rods could not be obtained, and evaluated as "B" for others in which wire rods were obtained. For those whose processability was evaluated as "D", no test piece was obtained, so items other than processability were not evaluated.

<Evaluation Method of Solid Phase Point>

Each test piece was heated to 2100° C. under an argon atmosphere in an electric furnace, and changes in appearance and cross-section after the temperature rise from before the temperature rise were visually observed. For those having no change in appearance and cross-section, the solid phase point was estimated to be 2100° C. or higher and evaluated as "B". Those with traces of melting on the appearance and cross-section were estimated to have a solid phase point of less than 2100° C. and evaluated as "D".

<Evaluation Method of Oxidative Consumption Resistance>

Each test piece was cut out to a length of 0.8 mm, heated in an electric furnace, and held at a predetermined temperature for 20 hours. The heating in the electric furnace was performed in the air atmosphere. In addition, the test was conducted under two conditions of 1000° C. and 1200° C. as the above-mentioned predetermined temperature. When the surface area of the test piece before heating is defined as S (unit: $mm^2$), the mass of the test piece before heating is defined as M0 (unit: mg), and the mass of the test piece after heating is defined as M1 (unit: mg), the mass change ΔM (unit: $mg/mm^2$) calculated by a formula (M1-M0)/S was used as an index indicating the oxidation consumption resistance of each test piece. The surface area S ($mm^2$) of the test piece was calculated from the dimensions of the test piece.

Regarding the oxidative consumption resistance when heated to 1000° C., the oxidative consumption resistance was evaluated as "A" (excellent) when ΔM is −0.25 or greater, and evaluated as "B" (good) when ΔM is less than −0.25.

Regarding the oxidative consumption resistance when heated to 1200° C., the oxidative consumption resistance was evaluated as "A" (excellent) when ΔM is −0.35 or greater, and evaluated as "B" (good) when ΔM is less than −0.35.

<Evaluation Method of Recrystallization Temperature>

By heating each test piece to a predetermined temperature and by confirming whether or not recrystallization has occurred after heating, the temperature at which recrystallization occurs for each test piece (that is, the recrystallization temperature) was measured. The recrystallization temperature was evaluated as "A" when the recrystallization temperature was higher than 1150° C., evaluated as "B" when the recrystallization temperature fell within a range between 1050° C., exclusive, and 1150° C., inclusive, and evaluated as "C" when the recrystallization temperature was equal to or less than 1050° C.

<Evaluation Method of High Temperature Strength>

The evaluation of high temperature strength was performed based on the tensile strength value obtained by conducting a tensile test at a high temperature for each test piece. As the test piece to be subjected to the tensile test, instead of the test piece which was the wire rod described above, one that was cut out, by wire electric discharge machining, from a plate material made of the same material as the test piece that was the wire rod was used. The test piece was cut out so that the cross-section of the parallel portion was a square of 0.5 mm×0.5 mm and the length of the parallel portion was 3 mm. The tensile test was performed under the conditions that the temperature of the test piece was 1200° C., the crosshead speed was 5 mm/min in the air atmosphere. The measured values of the high temperature strength shown in Table 1 indicate the obtained tensile strength values in the unit of "MPa".

The high temperature strength was evaluated as "A" when the measured tensile strength was greater than 550 MPa, evaluated as "B" when the tensile strength was greater than 250 MPa and less than or equal to 550 MPa, and evaluated as "C" when the tensile strength was less than or equal to 250 MPa.

<Total Evaluation>

Of the above evaluation items, the three items of oxidative consumption resistance, recrystallization temperature, and high temperature strength were comprehensively evaluated. 3 points are added for the item with an evaluation of "A", 2 points were added for an item with an evaluation of "B", 1 point was added for an item with an evaluation of "C", and 0 point was added for an item with an evaluation of "D". Total evaluation was performed based on the total score of the items. The total evaluation was "A" for test pieces with a total score of 12, "B" for test pieces with a total score of 9 to 11, and "C" for test pieces with a total score of 8 or less. The total evaluation of the test pieces whose processability was evaluated as "D" was "D".

As shown in Table 1, all of the test pieces of the examples had the total evaluation of A or B, and it was confirmed that they were good iridium alloys with high durability. On the other hand, the total evaluation of the test pieces of the comparative examples was C or D, and it was confirmed that the durability and processability were inferior to those of the examples.

As shown in Table 1, the densities of all the test pieces of the examples are 21.5 g/cm$^3$ or more. By setting the content of each of iridium, platinum, tantalum, and the above-mentioned additive in the iridium alloy within the range described above, the preferable density range is 21.5 g/cm$^3$ or more as a result. The present inventors have confirmed that, when another example different from those shown in Table 1 is prepared by changing the content of each element within the range of the first and second embodiment, the density of the iridium alloy having sufficient durability is equal to or greater than 21.5 g/cm$^3$.

The present embodiments have been described above with reference to concrete examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those described, and can be changed as appropriate. The combinations of the elements in each of the specific examples described above can be changed as appropriate, as long as it is not technically contradictory.

What is claimed is:

1. An iridium alloy consisting essentially of:

iridium; platinum; and tantalum, wherein a content of the platinum in the iridium alloy falls within a range from 5 wt % to 30 wt %, and a content of the tantalum in the iridium alloy falls within a range from 0.3 wt % to 5 wt %.

2. The iridium alloy according to claim 1, further comprising an additive made of cobalt, nickel, or both, wherein a content of the additive in the iridium alloy falls within a range up to 1.5 wt %.

3. The iridium alloy according to claim 2, wherein a total of the content of the tantalum and the content of the additive falls within a range up to 5 wt %.

* * * * *